United States Patent [19]

Avery

[11] 3,965,598

[45] June 29, 1976

[54] IDENTIFICATION DEVICE AND METHOD OF MAKING SAME

[75] Inventor: John R. Avery, Denver, Colo.

[73] Assignee: J. J. Avery, Inc., Denver, Colo.

[22] Filed: Nov. 14, 1974

[21] Appl. No.: 523,657

[52] U.S. Cl. ..... 40/135; 40/136; 264/129; 350/106

[51] Int. Cl.[2] ..... G09F 7/00

[58] Field of Search ..... 40/135, 136, 125 E, 40/125 N, 208, 130 B, 130 J; 427/271, 276; 264/129; 350/106, 109

[56] References Cited

UNITED STATES PATENTS

| | | | |
|---|---|---|---|
| 1,751,984 | 3/1930 | Eskilson | 350/106 |
| 1,899,971 | 3/1933 | Meehan | 40/136 UX |
| 1,902,440 | 3/1933 | Gill | 40/135 UX |
| 2,096,360 | 10/1937 | Heller | 40/28 C |
| 2,130,256 | 9/1938 | Wilson | 40/135 |
| 2,568,126 | 9/1951 | Keeley | 40/135 UX |
| 3,096,596 | 7/1963 | Magnuson et al. | 40/136 X |
| 3,449,158 | 6/1969 | Rowland | 350/106 X |

*Primary Examiner*—Louis G. Mancene
*Assistant Examiner*—John F. Pitrelli
*Attorney, Agent, or Firm*—Sheridan, Ross & Fields

[57] ABSTRACT

A stippled base sheet material with a coating thereon of color differing from the color of the base material is so constructed that when selected stipples are cut off, letters, numbers or other indicia may be formed of a color of the base material in a background the color of the coating. Also, method of making the sheet material, method of making an identification article therefrom, and the identification article are disclosed.

5 Claims, 4 Drawing Figures

IDENTIFICATION DEVICE AND METHOD OF MAKING SAME

BACKGROUND OF THE INVENTION

Identification indicia for use with objects, and fabricated at least in part by the owner of an object, are well known and of various forms. One familiar form comprises a suitable holder containing a blank card which may be readily purchased, the user printing or writing his name or other indicia on the card and affixing the holder and contained card to the object, such as luggage, to be transported by a public carrier. Similar identification tags for use on other objects or animals are also well known. In many instances the identification is printed or written on available gummed paper, cards, etc. which are affixed to the object. In each of the forms, the user may apply his personal identification, insignia, design, or other, to material which is readily available. These, of course, are only exemplary and a myriad of other identification or other insignia have been employed such as painting or printing on an article, applying gold leaf lettering, etc.

Another prior art example is in the making of signs by the user from fabricated blank material which he may modify to suit his needs. U.S. Pat. No. 1,089,996 to Walker is exemplary of such material which is similar to "boards" boards"employed in obtaining prizes by chance. It comprises a screen-like grid covered on both sides by opaque paper which may be selectively punched out to form the desired insignia.

SUMMARY OF THE INVENTION

The present invention serves the same general purpose as previously outlined, the principal difference being that the material comprises a sheet or strip of laminated material having embossed stipples formed on the sheet of one color and covered by a thin outer coating or lamination of another color. When the stipples are cut off in a desired pattern, the indicia formed is the color of the underlying or base material in a background the color of the coating. The stipples are preferably uniformly spaced in parallel rows at right angles to each other to form rectangular blocks of stipples in which a letter, number or other indicia may be formed by selection of the particular stipples to be cut off. The pattern is thus like that of an illuminated score board or the like at a sports event wherein selected lights in a block are energized to form a letter or number.

One of the objects of the invention, in accordance with the foregoing, is the provision of a stippled base sheet material having a coating thereon of a color differing from the color of the base material so that when the stipples are removed, or partially removed, a desired number, letter or other indicia may be formed which is the color of the base material in a background the color of the coating.

Another object is the provision of a method of making the material.

Another object is the provision of a method of making an identification article from the material.

A further object is the provision of the identification article.

Still further objects, advantages and salient features will become more apparent from the detailed description to follow, the appended claims, and the accompanying drawing to now be briefly described.

DESCRIPTION OF PREFERRED EMBODIMENTS

Figure 1:
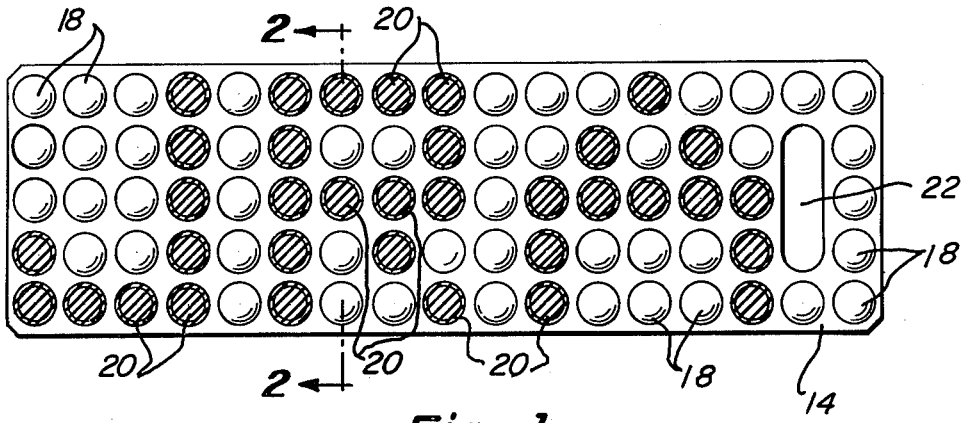
FIG. 1 is a plan view of one face of stippled sheet material forming the subject of the invention and an identification tag formed therefrom.
Figure 2:
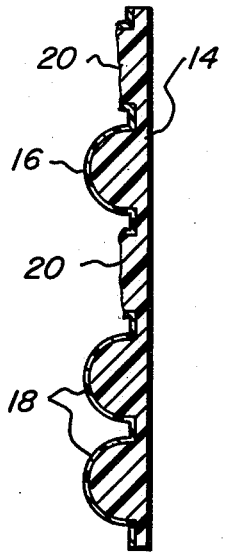
FIG. 2 is a section taken on line 2—2, FIG. 1 when the material is stippled on only one side.
Figure 2A:
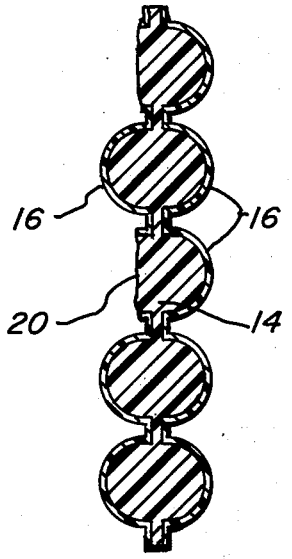
FIG. 2A is a like section when the material is stippled on both sides.
Figure 3:
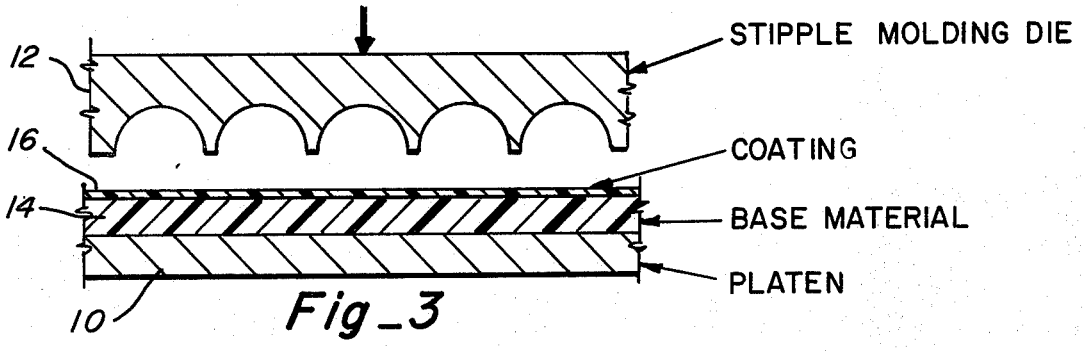
FIG. 3 illustrates method and apparatus for making the sheet material.

Referring now to the drawing and first to FIG. 3 which illustrates exemplary method and apparatus for forming stock material from which an identification article may be fabricated, platen 10 may be considered as the lower stationary flat platen of a conventional heat sealing press and molding die 12 as a forming die attached to the upper movable platen or ram (not shown) of the press. As will be understood, when heat flowable plastic material, such as vinyl, is disposed between the lower platen and die and heated and pressure applied, the material will flow and weld together. Heat is preferably applied to the material with a radio frequency generator which confines the heat to the material to thereby permit a rapid heating and cooling cycle. Apparatus of this type is manufactured by the Faratron-Division of Solidyne, Inc. Base material 14 and coating material 16 superimposed thereon are disposed between the platen and die and heated under pressure for a matter of seconds which flows the material into a configuration of upstanding stipples 18 disposed in quadrature, and forming a display matrix comprising several rows and columns as best shown in FIG. 1, and of generally hemispherical shape as shown in FIG. 2. This arrangement allows the greatest number of indicia forms to be made. FIG. 2A is of like construction except that stipples are formed on both sides of the material rather than on one side, as in FIG. 2. As will be understood, to form the material shown in FIG. 2A, a second die, like die 12, would be disposed on lower platen 10.

Referring now to FIGS. 1 and 2, tops of the stipples are removed as indicated at 20 to form a desired indicia which, as illustrated, is the initials "JRA" which exposes the color of the base material in a background of the color of the coating material. Any colors may be employed; however, they should preferably be contrasting colors, black and white probably being the most contrasting.

When the material is employed to provide an identification to an object to which it is attached, some means of attaching same will be required, illustrative of which is a cut-out through which a string, wire or strap may be passed and fastened to the object. When used as a luggage tag, a conventional luggage tag strap may be employed which may be fastened to a luggage handle. Similarly, it may be cemented to the object and in the construction shown in FIG. 2 the flat side of the material may be provided with a pressure sensitive cement and a protective removable overlay which may be removed to expose the cement for application to a face of an object, such as luggage. It is also possible in some applications to form the stipples on another underlying material, such as on a surface of a luggage case as will be apparent to one skilled in the art.

The invention has been described in detail with particular reference to a preferred embodiment thereof, but it will be understood that variations and modifications can be effected within the spirit and scope of the invention.

What is claimed is:

1. Sheet material comprising:

a. a sheet-like base member having stipples embossed on at least the front face thereof, said stipples being of one color, b. said stipples being uniformly spaced and in rows disposed in quadrature, to form a display matrix on said base member, c. an opaque coating of a different color on said face completely covering said face and the stipples thereon, d. at least a portion of each stipple and the coating material thereover being removable to expose the remaining stipple portion of the base member of contrasting color to the opaque coating over the remaining stipples, and thereby provide desired indicia, said base member and said opaque covering are made of a material which is readily severable by a sharp instrument for removing selected stipple and the coating thereover from said material to expose the remaining portion of the stipples and the spacing between stipples being such that a selected stipple may be removed without damaging an adjacent stipple.

2. Material in accordance with claim 1 wherein at least portions of some of the stipples and the coating material thereover are removed to provided desired indicia, such as identification indicia.

3. Material in accordance with claim 2 including means for attaching same to an object to be identified.

4. Material in accordance with claim 1 including like stipples on the other face thereof and an opaque coating of a color differing from the base color completely covering same, said stipples being removable along with the coating material thereover to provide desired indicia on said other face.

5. Material in accordance with claim 1, wherein: said base member and said opaque covering are made of a plastic material.

* * * * *